US006911651B2

(12) United States Patent
Senko et al.

(10) Patent No.: US 6,911,651 B2
(45) Date of Patent: Jun. 28, 2005

(54) ION TRAP

(75) Inventors: Michael W. Senko, Sunnyvale, CA (US); Jae C. Schwartz, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 10 days.

(21) Appl. No.: 10/477,022

(22) PCT Filed: May 8, 2002

(86) PCT No.: PCT/US02/14490

§ 371 (c)(1),
(2), (4) Date: Nov. 7, 2003

(87) PCT Pub. No.: WO02/091427

PCT Pub. Date: Nov. 14, 2002

(65) Prior Publication Data

US 2004/0195504 A1 Oct. 7, 2004

Related U.S. Application Data

(60) Provisional application No. 60/289,657, filed on May 8, 2001.

(51) Int. Cl.[7] ..... H01J 49/42

(52) U.S. Cl. ..... 250/292; 250/282; 250/281; 250/290

(58) Field of Search ..... 250/292, 290, 250/282, 281

(56) References Cited

U.S. PATENT DOCUMENTS

| | | | | |
|---|---|---|---|---|
| 5,629,519 | A | 5/1997 | Palermo | 250/292 |
| 5,714,755 | A | 2/1998 | Wells et al. | 250/281 |
| 6,087,658 | A | 7/2000 | Kawato | 250/292 |
| RE36,906 | E | 10/2000 | Franzen et al. | 250/292 |
| 6,831,275 | B2 * | 12/2004 | Franzen et al. | 250/292 |

* cited by examiner

*Primary Examiner*—Nikita Wells
(74) *Attorney, Agent, or Firm*—Wiggin and Dana LLP

(57) ABSTRACT

There is provided a quadruple ion trap (22) of the type including a ring electrode (24) and first and second end cap electrodes (26, 28), which define a trapping volume. The end cap electrodes (26, 28) include central apertures (30) for the injection of ions or electrons into the trapping volume and for the ejection of stored ions during the analysis of a sample. Field faults in the RF trapping field are compensated by addition of a concentric recess or depression in the surface of at least one end cap (26, 28) around the aperture (30). There is also provided an ion trap mass spectrometer employing the ion trap.

42 Claims, 8 Drawing Sheets

ION TRAP

CROSS-REFERENCE TO RELATED APPLICATION

"This patent application is the U.S. national phase of International Patent Application Ser. No. PCT/US02/14490, entitled "ION TRAP", that was filed on May 8, 2002 and published in English on Nov. 14, 2002 as International Publication No. WO 02/091427, and claims priority of U.S. Provisional Patent Application Ser. No. 60/289,657 entitled "Quadrupole Trap with Improved Fields" filed May 8, 2001, the disclosure of which is incorporated by reference herein in its entirety."

BACKGROUND OF THE INVENTION (1) Field of the Invention

This invention relates to the electrode structure and geometry of ion traps in general and to quadrupole ion traps and associated mass spectrometers in particular.

(2) Description of the Related Art

The ion trap of an ion trap mass spectrometer, in its most common configuration, is composed of a central ring electrode and two end cap electrodes (end caps). Generally, in longitudinal section, each electrode has a convex surface facing an internal volume known as the trapping volume. These surfaces are typically defined by central segments of a polynomial, which are often largely hyperbolic with small components of additional terms. In addition to providing a trapping space for ions, the trapping volume also serves as an analyzing space in which selected ions are retained and sequentially ejected, based upon their mass and charge (mass-to-charge ratio or m/z). It also serves as a reaction volume, in which fragmentation of charged particles is caused both by collisions and by interactions with additional specific fields. When a radio frequency (RF) voltage is applied between the ring and end cap electrodes, an electric potential is induced within the trapping volume which varies quadratically with displacement from the center of the trap. This potential produces a linear electric field which is advantageous for control of ion motion. Ions introduced into or formed within the trapping volume will or will not have stable trajectories, depending upon their mass, charge, the magnitude and frequency of the applied voltages, and the dimensions and geometry of the three electrodes.

Quadrupole ion trap potentials, and thus fields, deviate from the ideal for several reasons: 1) because the electrodes are of finite size; 2) because the shape or position of the electrodes are non-ideal; and 3) because of the apertures added to the end caps for introducing ions or electrons into the trapping volume and for ejecting ions from the trapping volume to an external detector. These deviations are referred to as field faults.

In the context of mass spectrometry using quadrupole ion traps, the field faults can result in both peak broadening and, in some cases, a shift in the measured ion mass from the theoretical mass values. Several techniques have been used and proposed to neutralize field fault effects on the motion of the trapped ions. See, for example, Franzen et al. U.S. Pat. No. 5,468,958, which describes a quadrupole ion trap with switchable multipole fractions which can be used to correct the electric potential errors due to the finite size of the electrodes, and Franzen et al. U.S. Pat. No. 6,297,500, which describes an electrode structure in which these electric potential errors due to the finite size of the electrodes is proposed to be corrected by narrowing the gap width between the ring and end cap electrodes at the edge regions where these electrodes are most closely proximate.

The field faults caused by the apertures in the end caps are generally more significant than those caused by finite electrode size. One method for correcting the deviations due to the apertures is to stretch the distance ($z_0$) between the end cap electrodes, and thus the spacing of one or both of the end cap electrodes from the ring electrode, beyond the theoretical spacing predicted by solving the equations of motion of charged particles contained within the trapping volume. Another approach is found in Kawato, U.S. Pat. No. 6,087,658, in which the inner surface of each end cap electrode is modified by the addition, around at least one of the apertures thereof, of a bulge protruding from the hyperbolic surface and extending inward to the associated aperture. The bulge is asserted to control the deviation in the electric potential around the end cap apertures from the ideal quadrupole electric potential.

The use of such altered electrode geometries provides a first order correction of field faults caused by the apertures, and an overall improvement in the linearity of the field. However, the overall improvement in the field linearity with the prior art methods can not be obtained without an unintentional degradation of the field in localized areas (e.g., at key locations between the trap center and the apertures in the vicinity of 60–70% of the distance therebetween).

Non-hyperbolic electrodes have been studied and implemented for quadrupole ion traps so as to take advantage of the material and labor economies associated with manufacturing electrodes of simpler shapes, such as cylindrical or spherical, but typically provide performance that is inferior to standard hyperbolic electrodes (Wells, et al., "A Quadrupole Ion Trap with Cylindrical Geometry Operated in the Mass-Selective Instability Mode" Analytical Chemistry, 70, 438–444, 1998).

SUMMARY OF THE INVENTION

In one aspect of the invention, there is provided a quadrupole ion trap of the type including a ring electrode and first and second end cap electrodes which define a trapping volume. The end cap electrodes include central apertures for the injection of ions or electrons into the trapping volume and for the ejection of stored ions during the analysis of a sample. Field faults in the RF trapping field are compensated by addition of a concentric recess or depression in the surface of at least one end cap around the aperture. There is also provided an ion trap mass spectrometer employing the ion trap.

Other aspects of the invention are directed to methods for designing ion traps and their electrodes. The geometric properties of such a recess may be optimized for field fault correction. The optimization of such factors may be performed iteratively in practice or in simulation. Advantageously, the optimization further corrects field faults for which initial first order correction has already been provided. An exemplary first order correction is a longitudinal outward shift of each electrode by a distance of 50%–150% of the aperture radius.

DETAILED DESCRIPTION

Figure 1:
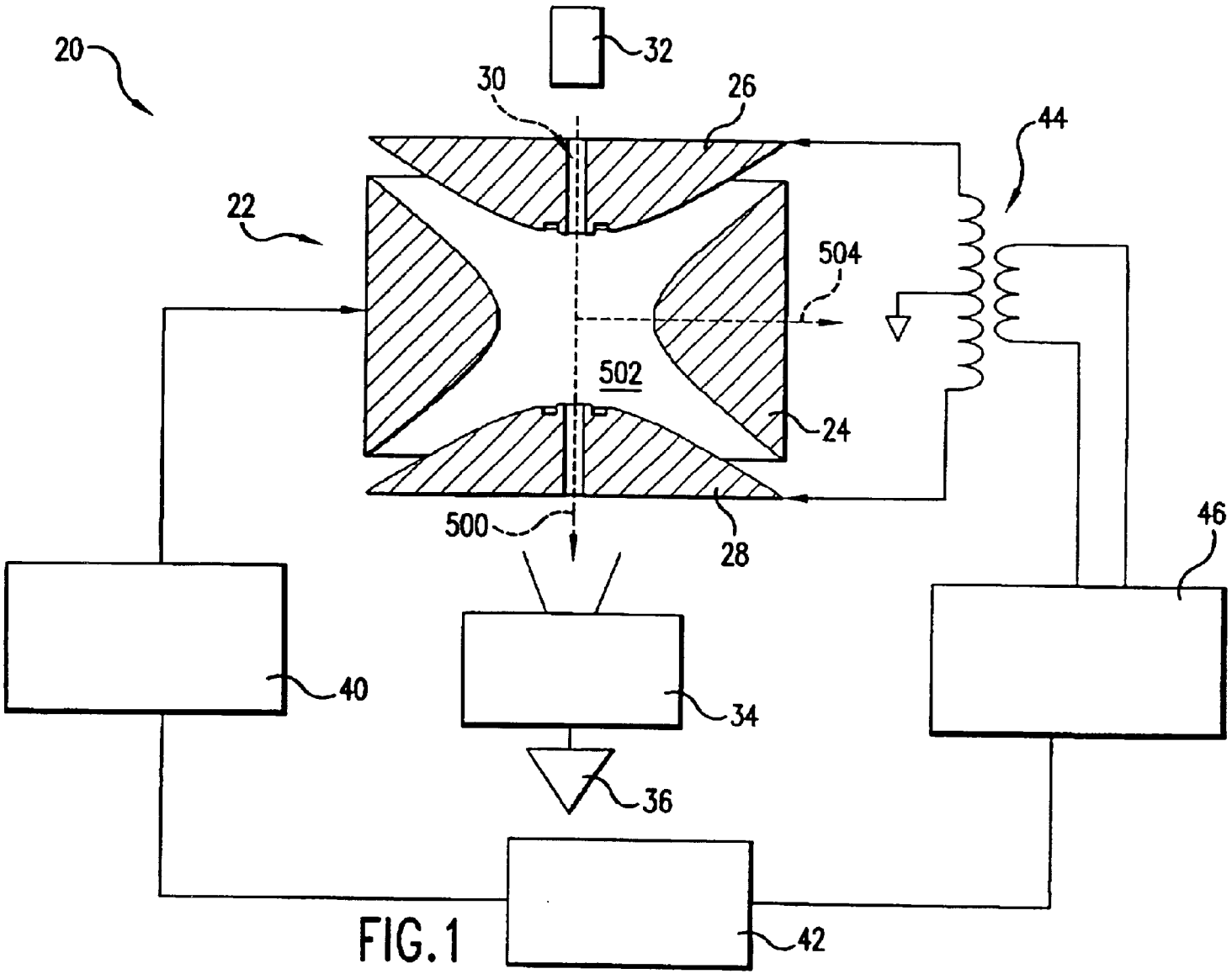
FIG. 1 is a schematic sectional view of an ion trap mass spectrometer according to one embodiment of the invention.

FIG. 1 shows a quadrupole ion trap mass spectrometer 20 that includes an ion trap 22 having a ring electrode 24 and first and second end cap electrodes 26 and 28. The ion trap has a central longitudinal axis 500 that is conventionally designated the Z-axis having an origin centrally within a trapping volume 502 in the trap interior. A radial direction 504 is shown extending from the origin. Each end cap electrode 26, 28 has a central aperture or channel 30. An electron gun 32 may inject electrons through the aperture 30 of the first (inlet) electrode 26 into the ion trap to ionize a sample. Alternatively, the sample may be ionized externally and the ions injected into the trap through that aperture. In either event, ions of interest are introduced into the trap. Such ions may escape the trapping volume space 502 through the aperture 30 of the second (outlet) electrode 28. These ions are then detected by the electron multiplier 34. The output of the electron multiplier is pre-amplified by pre-amplifier 36 and supplied to an associated processor (not shown).

To operate the ion trap, a fundamental RF generator 40 applies a suitable voltage between the ring electrode and the end cap electrodes to generate substantially quadrupolar potentials within the trapping space. These potentials create an electric field which contains ions over a predetermined m/z range of interest. The RF generator is controlled via a computer controller 42. The end caps 26, 28 are connected to the secondary of a transformer 44, which applies supplemental or excitation voltages across the end caps. The primary of the transformer 44 is connected to supplemental RF generator 46. Operation of the supplemental RF generator is controlled by the computer controller 42.

In one exemplary mode of operation (MS), the masses of the ions that have been trapped in the trapping volume by the RF trapping potentials are determined by employing the supplemental voltage to cause ions having a mass excited by a given frequency of supplemental RF voltage to be ejected from the ion trap through the second end cap's aperture where they are detected by the electron multiplier. In another exemplary mode of operation (MS/MS), the supplemental voltage has a frequency which excites parent ions. The energy applied to the end caps by the supplemental voltage causes a trapped parent ion to undergo collision-induced dissociation (CID) with background neutrals, producing daughter ions. The supplemental voltage is then used to eject the daughter ions of interest for detection as in the earlier-described MS mode. Other modes of operation for using an ion trap mass spectrometer to mass analyze a sample or selected ions of interest are known in the art.

Figure 2:
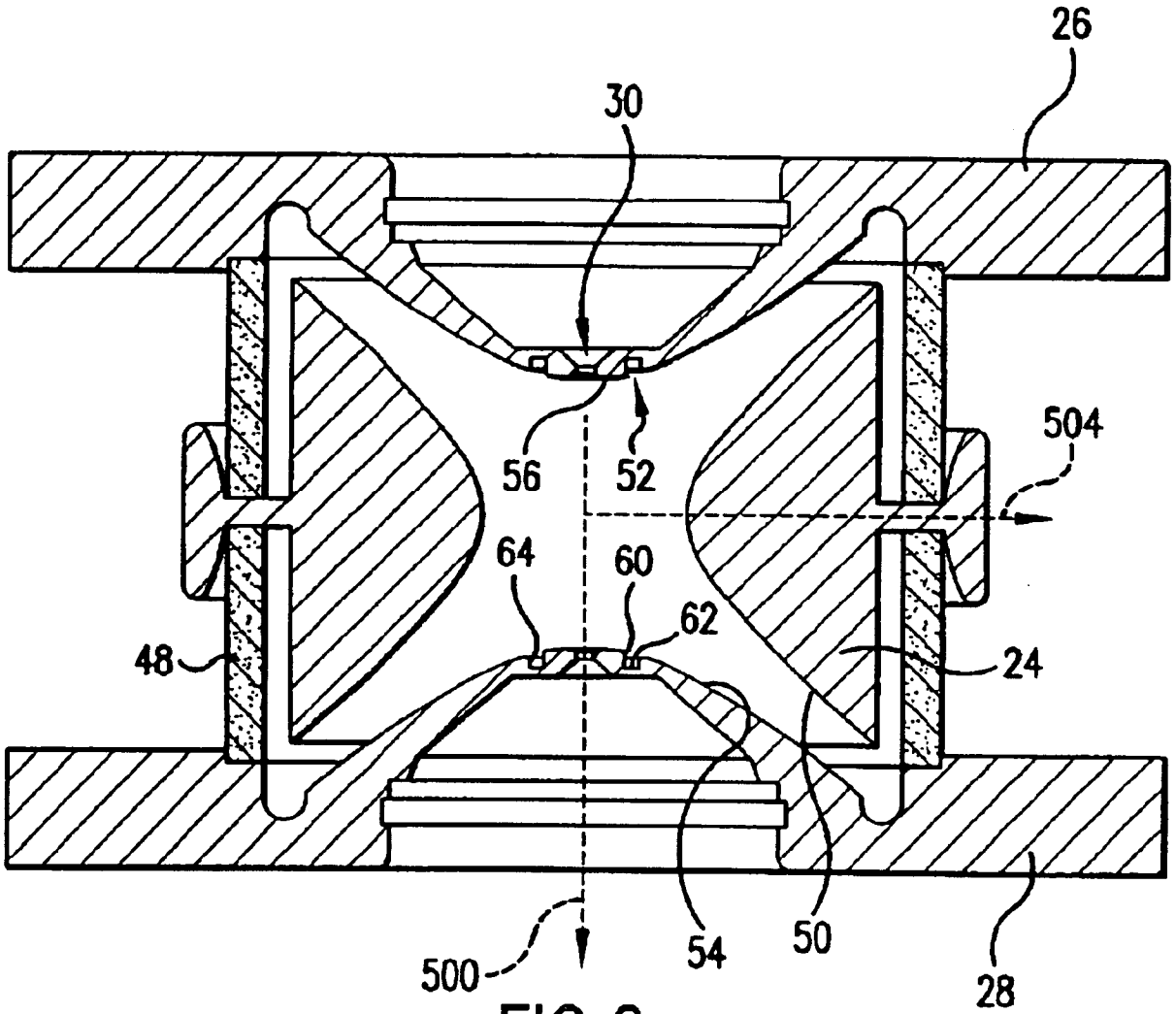
FIG. 2 is a longitudinal sectional view of the ion trap assembly of the spectrometer of FIG. 1.

FIG. 2 shows further details of the exemplary ring and end cap electrodes. These are substantially formed as solids of revolution about the axis 500, with key departures therefrom associated with mounting and manufacturing features. A quartz insulative sleeve 48 surrounds the ring electrode and maintains the relative positions of the end cap and ring electrodes spaced apart and electrically insulated from each other. An interior surface of the sleeve surrounds and is advantageously spaced apart from a principal exterior surface of the ring electrode and end surfaces of the sleeve are advantageously received in rebates in the end cap electrodes. The exemplary ring electrode has an inner surface 50 facing inward toward the Z-axis 500 and formed, in longitudinal section, as a central segment of a polynomial (approximately a hyperbola) along the radial direction 504. As heretofore described, the spectrometer and its ion trap may be substantially as found in the prior art. In the embodiment of FIG. 2, however, each end cap electrode has an inner surface facing the trapping volume formed with a recess 52 extending below (longitudinally distally or outward along the Z direction) a projection or virtual continuation of the polynomial that defines a principal surface of the associated end cap electrode. In the particular example, this surface has a first portion 54, the section of which is defined by such polynomial (e.g., a substantial hyperboloid with minor additional terms). This portion 54 extends longitudinally and radially outward from the recess 52. Between the recess 52 and the central aperture 30 is a second portion 56. In a basic embodiment, this second portion 56 falls along the same polynomial as does the first portion 54. The exemplary recess is 52 is blind, formed as a moat, namely a right channel having a longitudinal inboard surface 60, a radially-extending base surface 62, and a longitudinal outboard surface 64. As described below, the recess geometry may be optimized to provide a second order correction to field faults associated with the aperture of the end cap. For this simple right channel recess 52, geometric factors include: the channel radius (e.g., the radius of the channel at a location radially intermediate the surfaces 60 and 64); the width or radial span of the channel (e.g., the difference between the radii at the surfaces 64 and 60); and the channel depth (the longitudinal distance between the projection of the polynomial and the base surface 62 at that intermediate radial location).

A computer simulation was carried out using SIMION-3D, Version 7.00 program (available, for example from the Idaho National Engineering and Environmental Laboratories, Idaho Falls, Id.). The errors of the electric field as a function of displacement from the center of the trap toward the end cap were plotted for three examples: 1) with standard end caps each having a central aperture; 2) with such end caps each shifted 0.030 inch (0.76 mm) longitudinally out from their theoretical position to provide a first order correction as in commercially available ion traps; and 3) with similarly shifted end caps each modified to include a moat around the aperture. In the three cases, all electrodes are hyperbolic in section.

Figure 3:
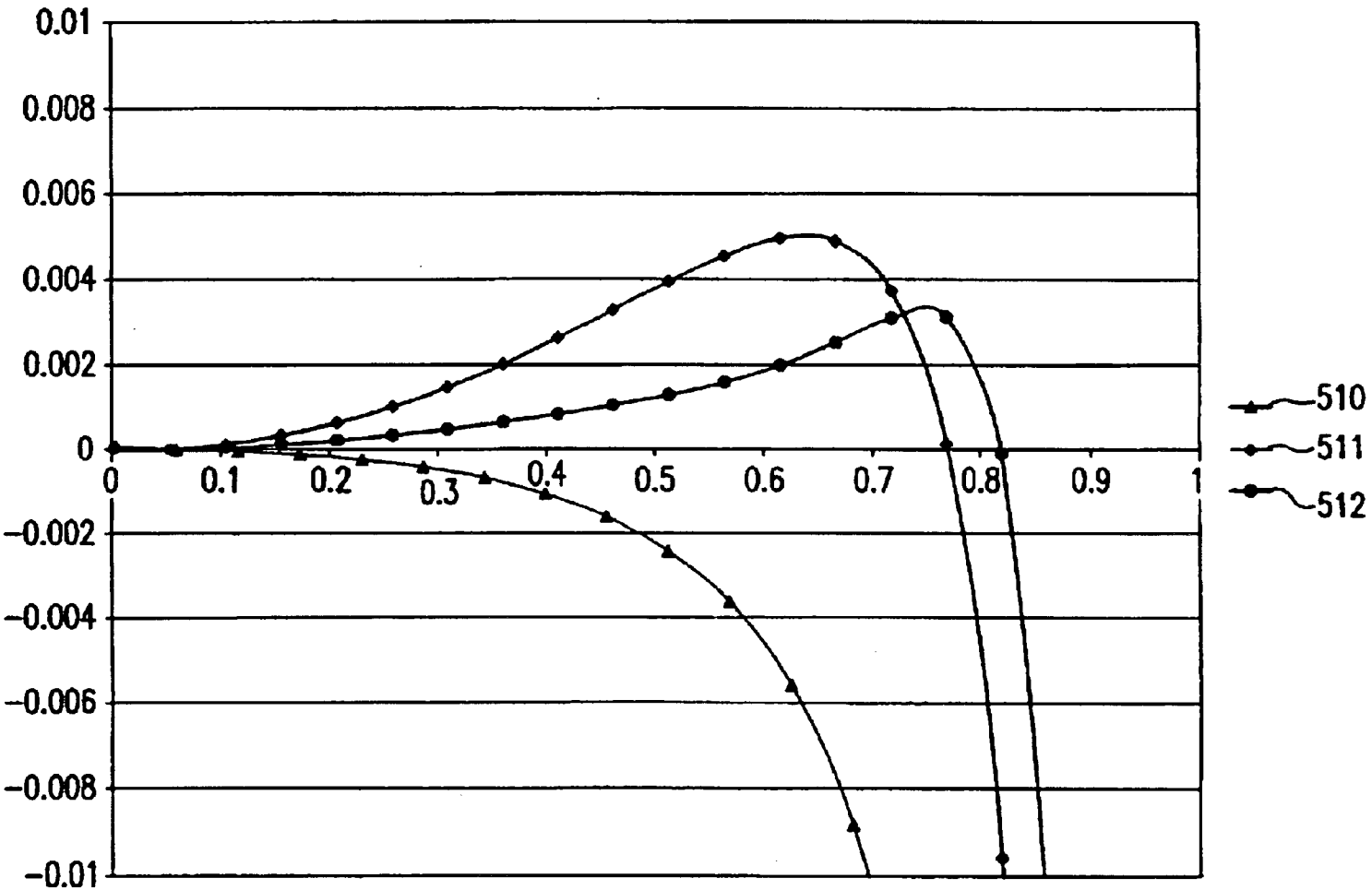
FIG. 3 is a graph of field error vs. displacement along the Z-axis for the trap of FIG. 2 relative to references.

FIG. 3 plots the positive or negative percentage of field error (i.e., relative to an ion trap with a theoretically ideal geometry and unapertured end caps) relative to the location along the Z-axis (0 being the origin and 1.0 being the intersection of the projected polynomial (hyperbola) with the Z-axis without any first order corrective shift). Line 510 (example (1) above) shows that the apertures included for injection and ejection of charged particles produce a field which weakens from the ideal quadrupole field as the displacement from the center of the trap increases. There is a negative error along the entire span between the origin and the aperture. This becomes increasingly significant about 60% of the way therebetween increasing massively at about 70%. The weakening of the field has been shown to cause poor performance in quadrupole ion traps. Line 511 (example (2) above) shows the effect of an outward shift of the end cap electrodes. The shift weakens the field throughout the trapping volume, however, the relative decrease in field is greater in the center of the trap than at large displacements. This provides a better match of the fields in the central and outer regions, resulting in improved performance. Unfortunately, the shift of the end caps results in an overcorrection of the field, with the positive field error maximizing at a lateral displacement from the origin of about 65%.

Line 512 (example (3) above) shows how creating a concentric depression around the aperture in the end cap can selectively weaken the field in this area. The amount of weakening can be controlled by the width, depth, and diameter of the recess. Line 512 shows the improvement in the field from adding a 1 mm wide, 0.9 mm deep moat with a 4.5 mm central diameter in an exemplary end cap having an aperture of 0.76 mm radius and substantially hyperbolic portion having an outer (maximum) radius of 19.2 mm.

The exact dimensions and shape parameters of the recess may be optimized iteratively or otherwise for a particular ion trap. Increasing width and/or depth of the channel (and thus its cross-sectional area for a given form) will tend to increase the second order correction associated with a given central radius, producing a field with less positive error. Decreasing the central radius is also believed to provide a correction with less positive error. These dimensions and channel shape may be traded off to provide generally similar field corrections or provide a particular displacement profile of field correction. The width/depth trade-off is not believed to be exactly linear over more than a small domain. It is believed that once the depth of a right channel equals the width, further increases in depth will have little additional effect on the field correction. The optimization of the parameters to achieve a desired deformation may be iteratively resolved on an embodiment of the ion trap. Such embodiment may be a physical embodiment such as one or more actual traps, partial traps, or models appropriately scaled for simulation purposes, or may be in the form of a computer or other simulation. If a physical embodiment, the process may, as physically appropriate, include modifications of a given part (e.g., widening or deepening of a channel may be performed on a given part) or may include preparing an otherwise similar or identical part with a different recess (e.g., it may be impractical to undo a machining operation to radially move a channel of given cross-section). In such an iterative design process, the trap may be tested under the anticipated conditions and the resulting effect on field is observed. The parameters may be varied and the simulation repeated until the field has a desired distribution.

The recess may take many forms. If the width of the basic right channel of FIG. 2 is extended so that its base intersects the polynomial-defined surface, the outboard surface is eliminated and the recess resembles more of a radial nick as shown in the electrode 100 of FIG. 4. This electrode has first and second portions 102 and 104 falling along a polynomial 106 in similar fashion to the portions 54 and 56 of the electrode of FIG. 2. The exemplary depression 108 is defined by a longitudinal inboard surface 110 extending from the perimeter of second surface 104 to a radially-extending base surface 112, which in turn extends radially outward to meet the first surface 102.

Figure 5:
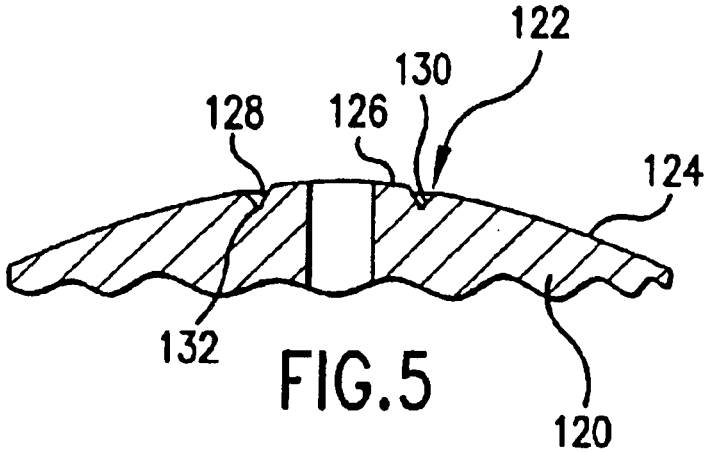
FIG. 5 is a schematic longitudinal sectional view of a second alternate end cap electrode geometry.
Figure 6:
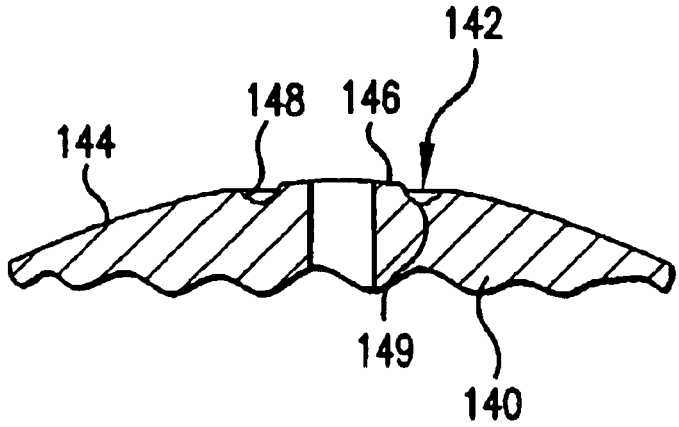
FIG. 6 is a schematic longitudinal sectional view of a third alternate end cap electrode geometry.

The nick surfaces may be other than exactly longitudinal and radial. For example, FIG. 5 shows another electrode 120 in which the recess 122 is formed having a V-shaped section. First and second surface portions 124 and 126 are on opposite sides of the recess 122. The recess has inboard and outboard walls 128 and 130 meeting at a vertex 132. In this example, the vertex 132 defines a single radial location of the longitudinal bottommost portion of the recess. FIG. 6 shows an electrode 140 having a recess 142 of a curved (e.g., semicircular) section. The recess is located between first and second surface portions 144 and 146 and is defined by a near semi-circular-sectioned surface 148 having a bottommost portion 149.

Figure 4:
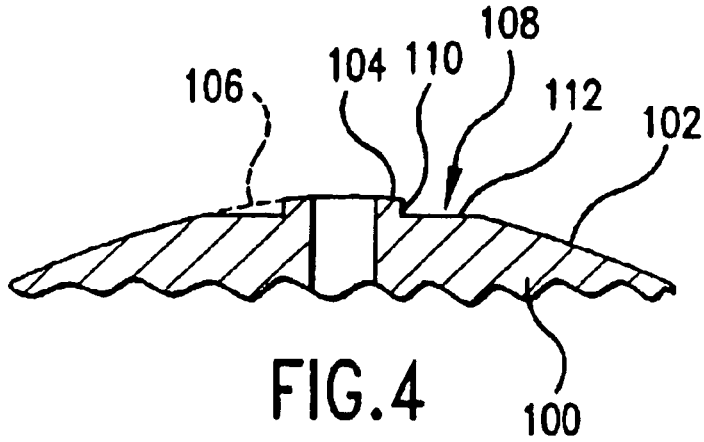
FIG. 4 is a schematic longitudinal sectional view of a first alternate end cap electrode geometry.
Figure 7:
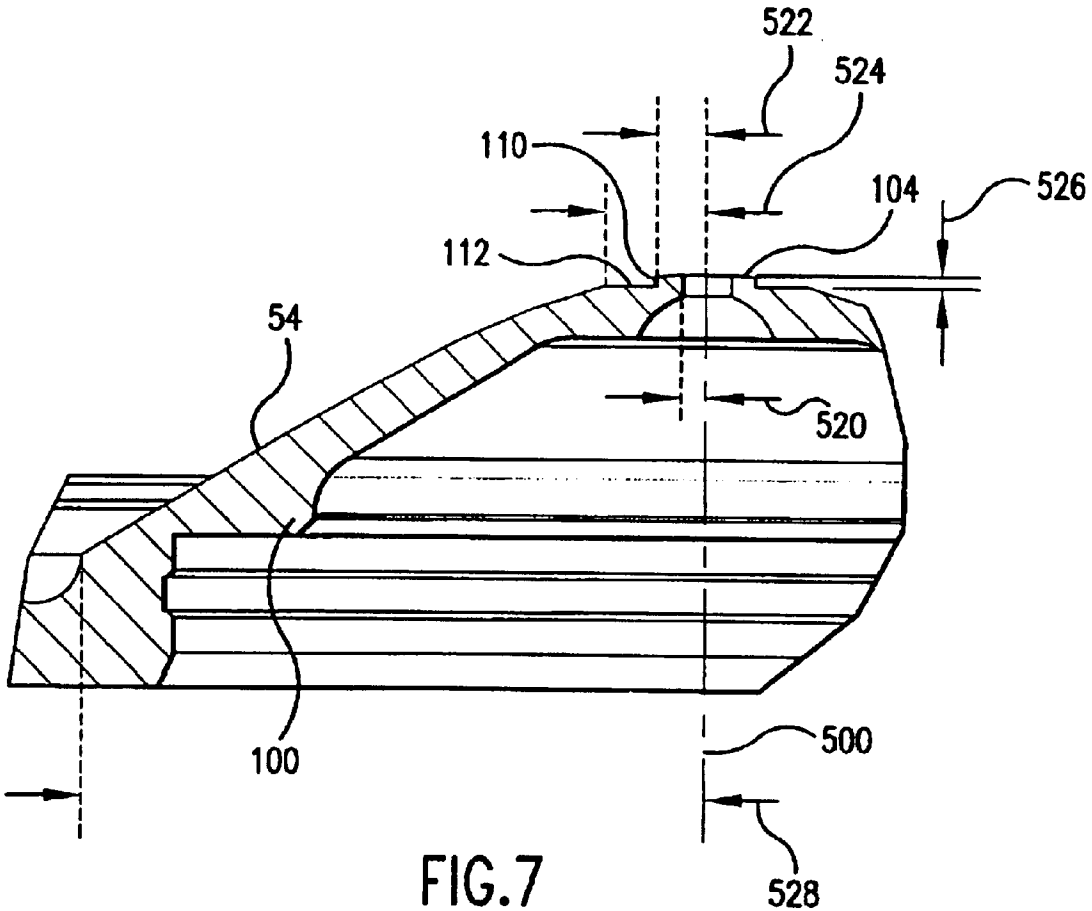
FIG. 7 is a partial longitudinal sectional view of the end cap of FIG. 4.

FIG. 7 shows further details of the electrode 100 of FIG. 4. As noted above, this electrode geometry provides a relative ease of manufacturing starting with an existing electrode lacking the recess. It has been found that such a recess in the end cap electrodes can be used in combination with a ring electrode of non-hyperbolic geometry (described below) to produce an ion trap mass spectrometer with performance that is equivalent or even superior to traditional ion traps. FIG. 7 shows an end cap electrode having a central aperture having a minimum radius 520 defined by a short cylindrical surface extending longitudinally outward from the second surface 104. An exemplary radius is 0.030 inch (0.76 mm). The perimeter of the second surface 104 has a radius 522, which is the radius of the inboard nick surface 110. An exemplary radius is 0.059 inch (1.5 mm). The intersection of the radial base surface 112 and first surface 102 has a radius 524. An exemplary radius is 0.123 inch (3.12 mm). A nick depth 526 is defined as the longitudinal span or length of the surface 110 (a depth at an intermediate point along the surface 112 being accordingly smaller). An exemplary depth is 0.014 inch (0.36 mm). The first surface 102 has an outer radius 528. An exemplary radius is 0.755 inch (19.18 mm). An exemplary radius of the inner surface of the insulator is 0.87 inch (22.10 mm).

Figure 8:
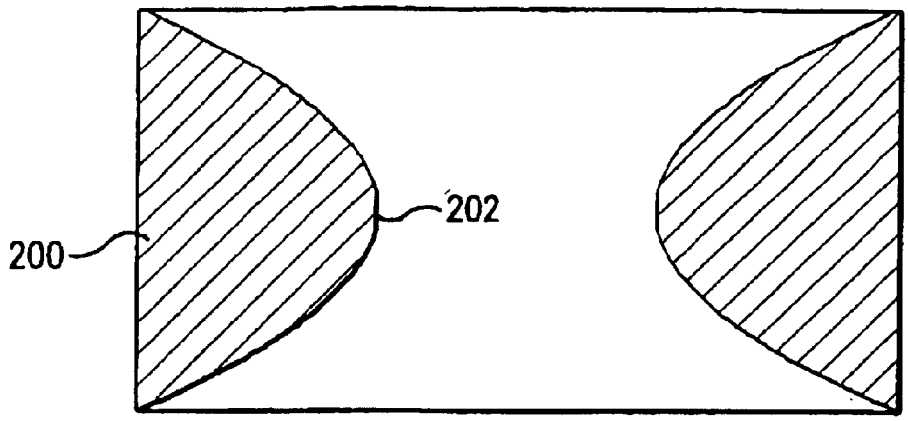
FIG. 8 is a schematic longitudinal sectional view of a first alternate ring electrode.
Figure 9:
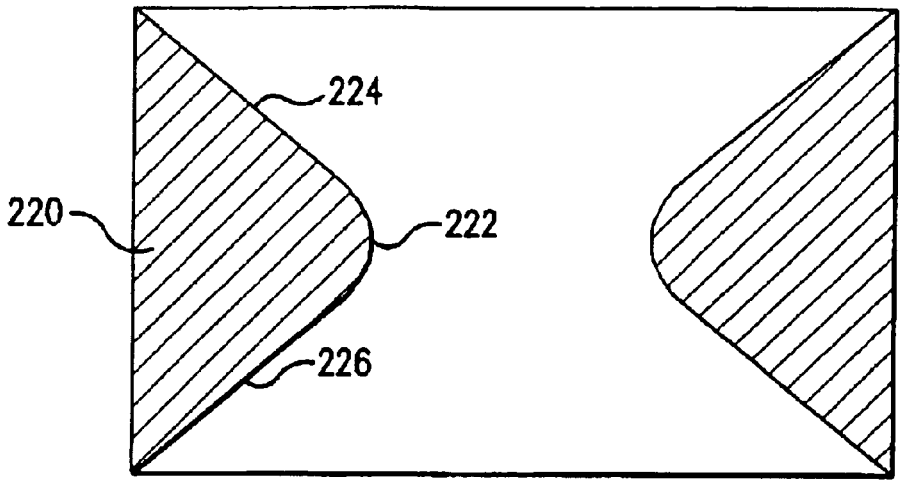
FIG. 9 is a schematic longitudinal sectional view of a second alternate ring electrode.

Among myriad possible non-hyperbolic ring electrode sections is a ring electrode 200 (FIG. 8) having a surface 202 defined by a segment of a parabola. Another alternate ring electrode 220 (FIG. 9) has a surface having portions which are straight in section, namely a central surface portion 222 formed as a segment of a circle and inlet and outlet side frustoconical surface portions 224 and 226. A third ring electrode 240 has a surface also having portions which are straight in section, namely a central cylindrical surface portion 242 and inlet and outlet side frustoconical surface portions 244 and 246. This electrode shape is desirable for commercial mass spectrometers because of the ease in manufacturing surfaces formed of interior cylindrical and frustoconical portions as compared with polynomial surfaces.

Figure 10:
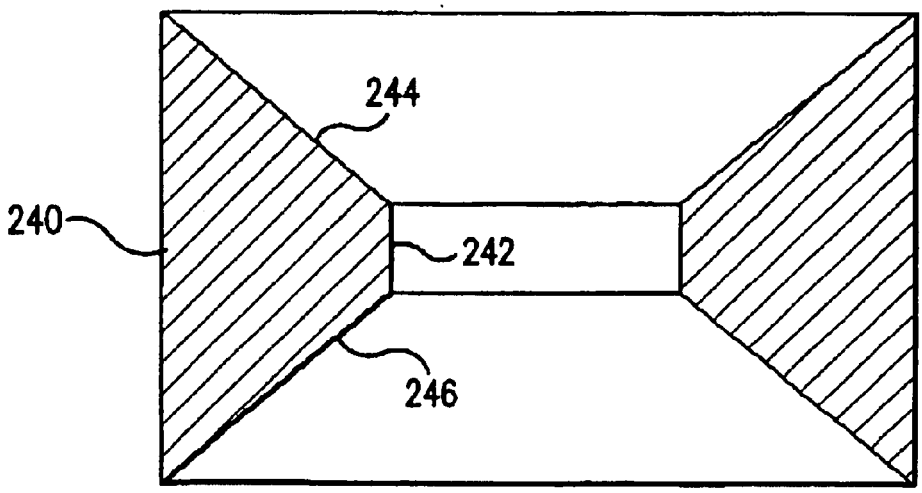
FIG. 10 is a schematic longitudinal sectional view of a third alternate ring electrode.
Figure 11:
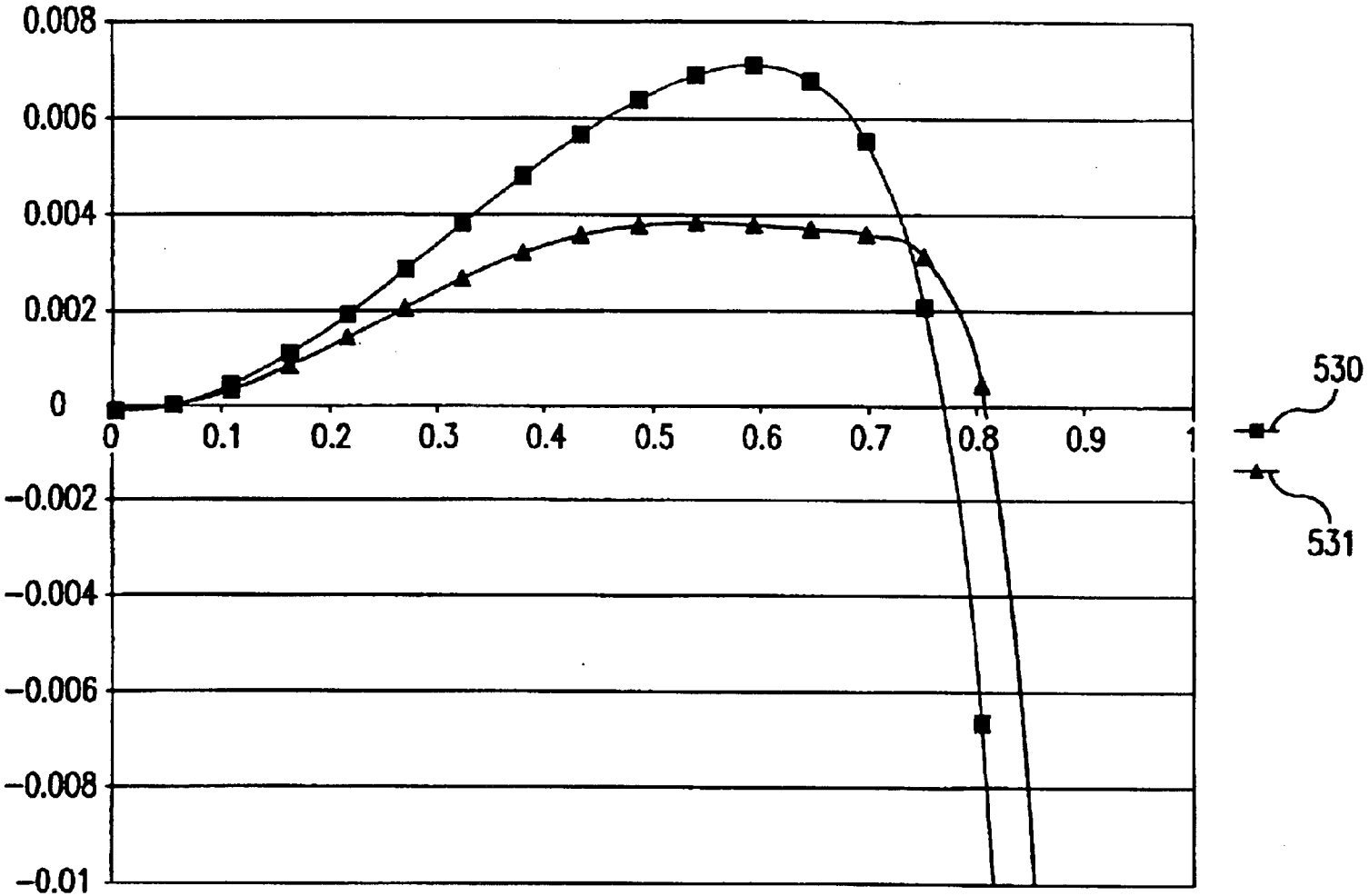
FIG. 11 is a graph of field error vs. displacement along the Z-axis from the center of the trap for a trap incorporating the electrode of FIG. 10 relative to a reference.

In FIG. 11, line 530 shows the field error percentages associated with unrecessed endcap electrodes in combination with a ring electrode such as ring electrode 240 of FIG. 10. This configuration of ring electrode produces a field which is overly strong at displacements approximately half way between center and the end cap. Line 531 shows field error improvements associated with use of end cap electrodes having nick-like recesses 108 of FIG. 4 in association with the same ring electrode. The field is much improved and the mass spectrometer is capable of producing data that can actually be better than one with standard hyperbolic electrodes.

Modifications as described herein may also improve performance of ion traps with non-hyperbolic end cap electrodes so that their performance is at least equivalent to standard ion traps. Myriad modifications to the basic end cap geometries may be possible. With reference to the electrode of FIG. 4 for convenience, in one modification the surfaces 102 and 104 need not both fall along the polynomial 106. If the surface 102 falls on the polynomial, the surface 104 may advantageously extend beyond it (i.e., longitudinally inward or closer to the origin or center of the trap). This may enhance the first order correction. In another modification, the surface 104, although falling along the polynomial, may be modified by the inclusion of a bulge such as shown in U.S. Pat. No. 6,087,658. The present recesses may also be combined with features such as shown in U.S. Pat. No. 6,297,500. Such recesses may also be adapted for use with multi-aperture end cap electrodes. Although advantageously of continuous annular form, it is also possible that the recesses may comprise discrete segments or other shapes. One or both end caps may have recesses and, if both, the recesses may take different forms.

Figure 12:
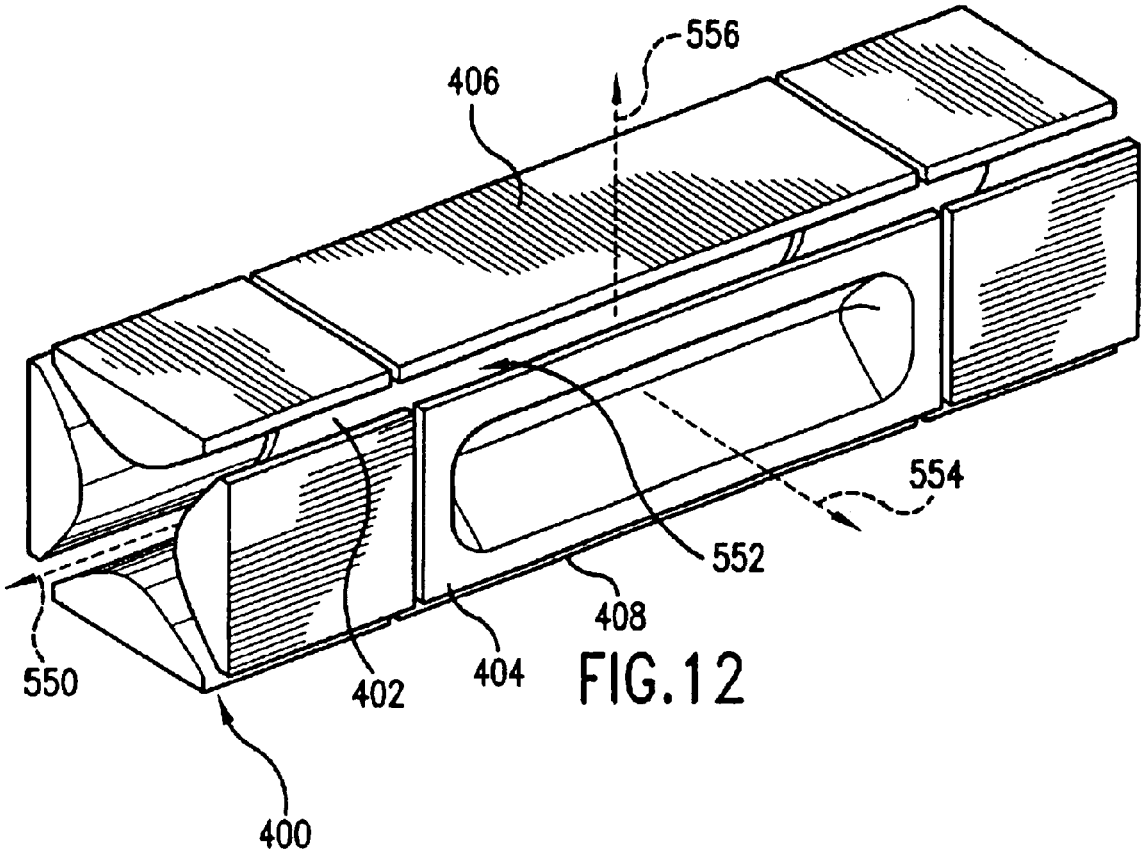
FIG. 12 is an isometric view of electrodes of a linear ion trap.
Figure 13:
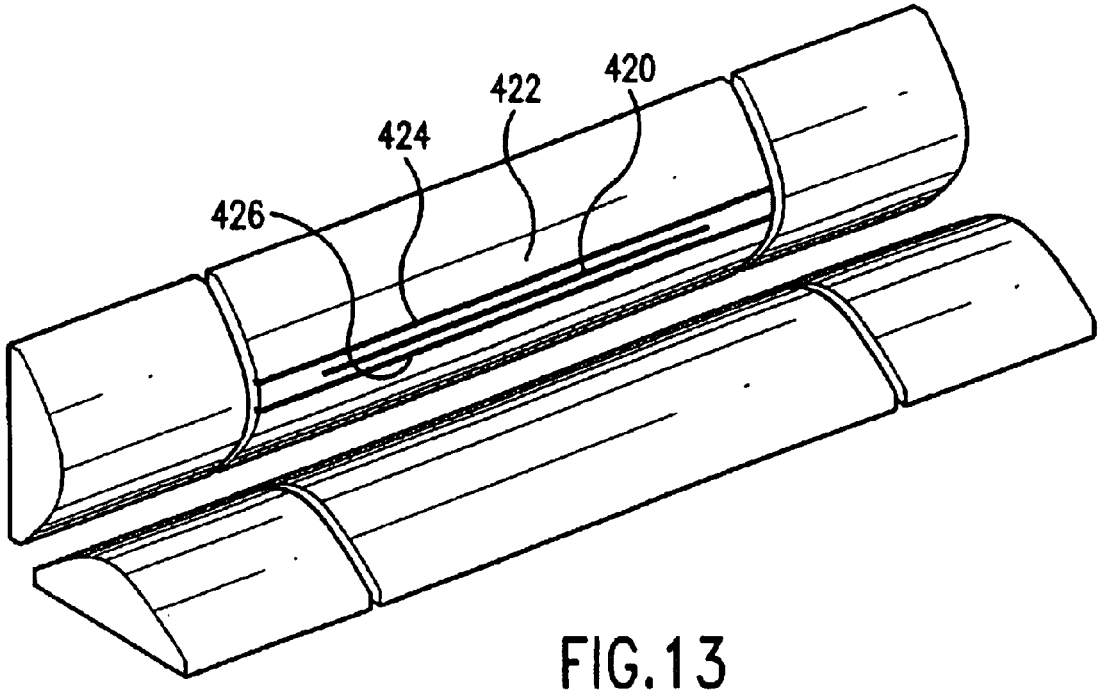
FIG. 13 is a view of one end and one side electrode of the trap of FIG. 12.

FIG. 12 shows a linear trap assembly 400 which may be a modification of that disclosed in copending U.S. patent application Ser. No. 60/355,436, filed Feb. 5, 2002 and entitled "Two-dimensional Quadrupole Ion Trap Mass Spectrometer", the disclosure of which is incorporated by reference herein as if set forth at length. A body portion of the trap includes two ejection electrodes 402 and 404 and two vertically placed electrodes 406 and 408. The electrodes extend parallel to a central axis 550 through a trapping volume 552. Centrally transverse to the axis 550 are an axis 554 extending centrally through the electrodes 402 and 404 and an axis 556 extending centrally through the electrodes 406 and 408. When viewed in section transverse to the axis 550, the inner surfaces of the electrodes 402 and 404 may appear similar to the inner surfaces of the previously-described end cap electrode and the inner surfaces of the electrodes 406 and 408 may appear similar to the inner surface of the previously-described ring electrodes, with axis 554 replacing the Z-axis and axis 556 replacing the radial direction. The electrodes 402 and 404 each have a central aperture formed as a logitudinally-extending slot 420. Along either side of this aperture, the inner surface 422 may include depression means which may be formed as a pair of depressions 424 and 426 or an obround or similarly-shaped depression encircling the aperture. These depressions may have similar cross-sectional forms to those described above.

The foregoing descriptions of specific embodiments of the present invention are presented for the purposes of illustration and description. They are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A quadrupole ion trap comprising a ring electrode and first and second end cap electrodes, said first and second end cap electrodes each including a central aperture, and a concentric depression around the aperture of at least one of said first and second end cap electrodes.

2. A quadrupole ion trap as in claim 1 in which the depression is in the shape of a moat with flat sidewalls and a flat bottom.

3. A quadrupole ion trap as in claim 1 in which the depression is in the shape of a partial circle.

4. A quadrupole ion trap as in claim 1 in which the depression is in the shape of a V.

5. A quadrupole ion trap as in claim 1 in which the depression is in the shape of a nick, with an inner wall extending longitudinally and a bottom extending radially.

6. A quadrupole ion trap comprising a non-hyperbolic ring electrode and first and second end cap electrodes, said first and second end cap electrodes each including a central aperture, and a concentric depression around the aperture of at least one of said first and second end cap electrodes.

7. A quadrupole ion trap as in claim 6 in which the depression is in the shape of a moat with flat sidewalls and a flat bottom.

8. A quadrupole ion trap as in claim 6 in which the depression is in the shape of a partial circle.

9. A quadrupole ion trap as in claim 6 in which the depression is in the shape of a V.

10. A quadrupole ion trap as in claim 6 in which the depression is in the shape of a nick, with an inner wall and a bottom extending to the edge of the end cap.

11. A quadrupole ion trap as in claim 6 in which the non-hyperbolic ring electrode has a parabolic cross-section.

12. A quadrupole ion trap as in claim 6 in which the non-hyperbolic ring electrode has a circular cross-section.

13. A quadrupole ion trap as in claim 6 in which the non-hyperbolic ring electrode has a cross-section of two or more linear components.

14. An ion trap mass spectrometer including a quadrupole ion trap comprising a ring electrode and first and second end cap electrodes, said first and second end cap electrodes each including a central aperture and a concentric depression around the aperture of at least one of said first and second end cap electrodes.

15. An ion trap comprising a ring electrode and first and second end cap electrodes, said first and second end cap electrodes each having at least one aperture, and a concentric depression around at least one aperture of at least one of said first and second end cap electrodes.

16. An ion trap comprising:

a ring electrode having a central axis and an annular inner facing surface; and first and second end cap electrodes each having at least one aperture and having an inner-facing surface, said inner-facing surfaces cooperating with the ring electrode annular inner-facing surface to at least in part define a trapping volume, wherein at least one of the first and second electrode inner-facing surfaces has an annular channel surrounding said at least one aperture.

17. The ion trap of claim 16 wherein:

a longitudinal bottommost portion of the channel is at a radius of between 200% and 1000% of a minimum radius of said at least one aperture.

18. An ion trap comprising:

a ring electrode having a central axis and an annular inner facing surface; and first and second end cap electrodes each having at least one aperture and having an inner-facing surface, said inner-facing surfaces cooperating with the ring electrode annular inner-facing surface to at least in part define a trapping volume, wherein at least one of the first and second electrode inner-facing surfaces comprises:

a first portion formed as a segment of a polynomial of revolution about said central axis;

a second portion, inboard of said first portion and also formed as a segment of said polynomial; and a third portion, between said first and second portions, and located longitudinally distally of said polynomial.

19. The ion trap of claim 18 wherein:

the at least one aperture of the at least one end cap electrode includes a central aperture which has a minimum radius and a maximum radius which may be coincident therewith;

a most longitudinally outward part of the second portion is at a radius of between one and five times said minimum radius of the at least one aperture;

the first portion has a radial span of at least 12.5 times said minimum radius of the at least one aperture; and the third portion has a radial span of at least 75% of said minimum radius of the at least one aperture.

20. The ion trap of claim 18 wherein:

the at least one aperture of the at least one end cap electrode includes a central aperture which has a minimum radius and a maximum radius which may be coincident therewith;

a most longitudinally outward part of the second portion is at a radius of between 4% and 20% of a maximum radius of the first portion;

the first portion has a radial span of at least 50% of said maximum radius of the first portion; and the third portion has a radial span of at least 3% of said maximum radius of the first portion.

21. The ion trap of claim 18 wherein:

a longitudinal outward shift of the first portion relative to a longitudinal position of the closest hyperbolic approximation is 50% 100% of said minimum aperture radius.

22. An ion trap comprising:

a ring electrode having a central axis and an annular inner facing surface; and first and second end cap electrodes each having at least one aperture and having an inner-facing surface, said inner-facing surfaces cooperating with the ring electrode annular inner-facing surface to at least in part define a trapping volume, wherein along a longitudinal radial section through the first end cap electrode the inner-facing surface profile thereof has a continuously curving convex first portion, a concave second portion inboard of the first portion and a continuously curving convex third portion inboard of said second portion.

23. The ion trap of claim 22 wherein:

the first end cap electrode first portion has a maximum radius; and a transition between the second and third portions occurs at a transition radius between 5% and 15% of said maximum radius.

24. The ion trap of claim 22 wherein:

the at least one aperture of the at least one end cap electrode includes a central aperture which has a minimum radius and a maximum radius which may be coincident therewith; and a transition between the second and third portions occurs at a transition radius between 1.5 and five times said minimum radius of the at least one aperture.

25. The ion trap of claim 22 wherein:

the first end cap electrode aperture has a minimum radius and a maximum radius which may be coincident therewith;

the first portion has a radial span of at least 12.5 times said minimum radius of the at least one aperture;

the second portion has a radial span of at least 50% said minimum radius of the at least one aperture; and the third portion has a radial span of at least 75% said minimum radius of the at least one aperture.

26. The ion trap of claim 22 wherein:

the first portion has a radial span of at least 50% of the first portion maximum radius;

the second portion has a radial span of at least 4% of the first portion maximum radius; and the third portion has a radial span of at least 3% of the first portion maximum radius.

27. An ion trap comprising:

a ring electrode having a central axis and an annular inner facing surface; and first and second end cap electrodes each having at least a central aperture and having an inner-facing surface, said inner-facing surfaces cooperating with the ring electrode annular inner-facing surface to at least in part define a central trapping volume, wherein along a longitudinal radial section through the first end cap electrode the inner-facing surface profile thereof has, in sequence:

a first portion extending at least partially radially outward beyond the first end cap electrode central aperture;

a second portion extending at least partially longitudinally outward from the first portion and then at least partially radially outward and then at least partially longitudinally inward; and a third portion extending radially and longitudinally outward from the second portion over a longitudinal and radial extent greater than the first and second portions combined.

28. An ion trap comprising:

a ring electrode having a central axis and an annular inner facing surface; and first and second end cap electrodes each having at least one aperture and having an inner-facing surface, said inner-facing surfaces cooperating with the ring electrode annular inner-facing surface to at least in part define a trapping volume, wherein when at least one of the first and second end cap electrodes has a concentric depression around said at least one aperture, a quadrupolar field inside said trapping volume is substantially uniform, and the presence of the concentric depression reduces a maximum positive field error by greater than 30% relative to an end cap without the depression over strengthened at displacements of about 50% from the center of the trap.

29. An ion trap comprising:

first and second electrodes each having at least one aperture and having an inner surface facing a trapping volume, wherein at least one of the first and second electrodes has, at least one depression below a remaining surface portion defined by a polynomial.

30. The ion trap of claim 29 wherein said electrodes are linear electrodes and said at least one depression comprises first and second recesses on opposite sides of an elongate aperture.

31. The ion trap of claim 29 wherein said depression provides a field correction secondary to a primary field correction associated with a positioning of the electrodes relative to a center of the trap.

32. The ion trap of claim 29 wherein said depression is in the shape of a moat with flat sidewalls and a flat bottom.

33. The ion trap of claim 29 wherein said depression is in the shape of a partial circle.

34. The ion trap of claim 29 wherein said depression is in the shape of a V.

35. The ion trap of claim 29 wherein said depression is in the shape of a nick, with an inner wall extending longitudinally and a bottom extending radially.

36. The ion trap of claim 29 wherein the electrodes are segmented.

37. The ion trap of claim 29 wherein said electrodes are non-hyperbolic.

38. The ion trap of claim 37 wherein said non-hyperbolic electrodes have a circular cross section.

39. A method for optimizing the design of an ion trap electrode to provide a desired electric field within the trap, the method comprising the steps of:

providing an embodiment of said design having at least a first convex surface viewed in a first section and an aperture;

providing a recess inboard of the first convex surface;

operating the ion trap;

observing an electric field associated with the electrode; and repeating the steps of:

revising the design by varying at least one parameter of: the shape of the recess; the radial position of the recess; and the sectional dimensions of the recess;

operating the ion trap with the revised design; and observing an electric field associated with the revised design, until the field associated with a particular revised design is within a desired distribution.

40. The method of claim 39 wherein the embodiment is a computer simulation.

41. The method of claim 39 wherein the repeated steps are performed as a secondary correction to reduce a maximum positive field fault associated with primary correction.

42. An ion trap mass spectrometer including an ion trap comprising first and second electrodes each having at least one aperture and having an inner surface facing a trapping volume, wherein at least one of the first and second electrodes has, at least one depression below a remaining surface portion defined by a polynomial.

* * * * *